US005834724A

United States Patent [19]

Asakawa et al.

[11] Patent Number: 5,834,724

[45] Date of Patent: Nov. 10, 1998

[54] CIRCUIT BREAKER WITH GRID SUPPORT MOUNTED OVER STATIONARY CONTACTOR

[75] Inventors: Koji Asakawa; Naoshi Uchida; Kyoji Hama, all of Kawasaki, Japan

[73] Assignee: Fuji Electric Co., Ltd., Kanagawa, Japan

[21] Appl. No.: 668,438

[22] Filed: Jun. 17, 1996

[30] Foreign Application Priority Data

Jun. 20, 1995 [JP] Japan ..... 7-176673

[51] Int. Cl.[6] ..... H01H 33/18; H01H 33/02

[52] U.S. Cl. ..... 218/36; 218/37; 218/150

[58] Field of Search ..... 218/36, 37, 40, 218/41, 148, 150, 151; 335/16, 147, 195, 201

[56] References Cited

U.S. PATENT DOCUMENTS

| | | | |
|---|---|---|---|
| 3,243,559 | 3/1966 | Heft | 218/149 |
| 4,516,003 | 5/1985 | Yoshiyasu et al. | 200/144 C |
| 4,649,242 | 3/1987 | Kralik | 200/147 R |
| 5,206,614 | 4/1993 | Carothers | 335/16 |
| 5,247,142 | 9/1993 | Yonkovitz et al. | 200/144 R |
| 5,589,672 | 12/1996 | Uchida et al. | 218/34 |

FOREIGN PATENT DOCUMENTS 55-96548 12/1980 Japan .

OTHER PUBLICATIONS

Y. Ito, et al., 5th IEEE Comsoc International Workshop on Multimedia Communications, pp. 3–4–1 to 3–4–6, May 1994, "A Video Server Using ATM Switching Technology".

51st Nat. Conf. of the Info. Proc. Society of Japan, 5D–9, pp. 4–141 to 142, Sep. 20, 1995, "A Study of Multiple Trickplay on Video Sensor".

Y. Ishibashi, et al., Technical Report of IEICE, CS 92–74, IE 92–96, pp. 101–106, Dec. 1992, "Multiple–access Visual Search for Digital Video–on–demand Services".

T. Mori et al., Technical Report of IEICE, IE94–81, pp. 9–16, Nov. 1994, "Video Storage and Visual Search Techniques in VOD System".

*Primary Examiner*—Michael L. Gellner
*Assistant Examiner*—Michael J. Hayes
*Attorney, Agent, or Firm*—Pearne, Gordon, McCoy & Granger LLP

[57] ABSTRACT

In a circuit breaker, a grid support (12) having a pair of side walls (12*a*) which are confronted with each other, is provided by molding resin, and arc-extinction grids (6) are inserted into grooves formed in the side walls (12*a*). The grid support is fixedly mounted on the stationary contactor (1) by fitting legs (12*c*) protruded from the bottom surfaces of the side walls (12*a*) into a U-shaped hole (9) formed in the stationary contactor (1) which defines outside current paths (1*a*) and an inside current path (1*b*). The upper surfaces of the outside current paths (1*a*) are covered with the side walls (12*a*), respectively, and the upper surface of the inside current path (1*b*) except for a stationary contact (3) is covered with the cover plate (12*b*) through which the side walls (12*a*) are connected to each other.

10 Claims, 6 Drawing Sheets

CIRCUIT BREAKER WITH GRID SUPPORT MOUNTED OVER STATIONARY CONTACTOR

BACKGROUND OF THE INVENTION

This invention relates to circuit breakers such as wiring breakers and earth leakage breakers, and more particularly to an improvement of a circuit breaker which is so designed that arcs produced when current is cut off are driven towards an arc-extinction grid by the action of a current which flows in the stationary contactor.

A circuit breaker is well known in the art in which a stationary terminal made of a flat conductive plate has a terminal at one end, and the other end portion of the stationary terminal is bent U-shaped, and a stationary contact is formed on the end of the end portion thus bent. FIGS. 8 and 9 show the contactor of a conventional circuit breaker of this type. More specifically, FIGS. 8 and 9 are a plan view and a side view, respectively, showing the contactor. In FIGS. 8 and 9, reference numeral 1 designates a stationary contactor. The left end portion of the stationary contactor 1 are bent, thus forming a terminal, and the right end portion is bent U-shaped. A stationary contact 3 is mounted on the end of the right end portion thus bent. Reference numeral 5 designates a movable contactor 5 which has a movable contact 4 which is engageable with the stationary contact. The movable contactor 5 is swingably supported by a movable contactor holder, and it is swung between a circuit closing position (indicated by the solid lines) and a circuit opening position (indicated by the chain lines) by means of an opening and closing mechanism (not shown).

Arc-extinction grips 6 are set in a plurality of layers surrounding the stationary and movable contactors 1 and 5. Those arc-extinction grids 6 are supported by a pair of side boards 7 of an insulating material (such as fiber board, and polyester glass mat laminate board). Each of the arc-extinction grids 6 is a U-shaped magnetic plate having protrusions 6*a* at both ends. The arc-extinction grids 6 are supported on the side boards 7 with the protrusions 6*a* secured to the latter 7 by caulking. When a current flowing in the direction of the arrow in FIG. 9 is cut off, an arc 8 is produced between the stationary and movable contacts 3 and 4. In this operation, because of the action of the magnetic field H of the current flowing the bent end portion of the stationary contactor 1, a force F is applied to the arc 8 to move the latter 8 to the left (in FIG. 9); that is, towards the inner part of the arc-extinction grids. Furthermore, the arc induction action of the arc-extinction grids 6 acts to move the arc 8 deeper in the latter 6. On the other hand, the arc is elongated, cooled, and split, so that the arc voltage is increased. Thus, finally, the arc is extinguished.

In the circuit breaker having the stationary contactor 1 with the stationary contact 3 on its bent end portion, it is possible to cause the magnetic field H to act in the direction in which the arc should be elongated. Hence, the aforementioned circuit breaker is advantageous in that it is superior in current interrupting performance to a circuit breaker in which the stationary contact is mounted on the stationary contactor which is not bent. However, it suffers from the following difficulty: That is, the stationary contact mounting position is relatively high because the stationary contactor 1 is bent, and therefore in order to provide a sufficiently long opening distance for the movable contactor 5, it is necessary to increase the height of the circuit breaker in correspondence to the opening distance; that is, the resultant circuit breaker is unavoidably bulky. In order to overcome this difficulty, a stationary contactor has been disclosed in the art in which the above-described action of the magnetic field is effected although the stationary contact is not bent (cf. Japanese Utility Patent Application (OPI) No. 96548/1980 (the term "OPI" as used herein means an "unexamined publication application")).

FIG. 10 is a plan view showing the conventional stationary contactor of this type, and FIG. 11 is a sectional side view taken along line XI—XI in FIG. 10. In those figures, reference numeral 1 designates a stationary contactor. The stationary contactor 1 is made up of a flat conductive plate, and has the left end portion which is formed into a power terminal section 2, and the right end portion where a U-shaped hole 9 is formed. The presence of the U-shaped hole 9 forms a pair of outside current paths 1*a*, and an inside current path 1*b*. That is, the outside current paths 1*a* are extended from the terminal section 2, and then joined together to follow the inside current path 1*b* which is bent towards the terminal section 2. The inside current path 1*b* has a stationary contact 3 at the end. Hence, a current flowing in the contactor through the terminal section 2 is caused to flow along the two outside current paths 1*a*, and then join together to flow the inside current path 1*b* to the stationary contact 3. As a result, at the interruption of current, the magnetic field H of the current flowing along the inside current path 1*b* acts to apply a leftward force F to the arc 8 which is produced at the interruption of current; that is, the arc is driven towards the inner part of the arc-extinction grids. The terminal section 2 has a threaded hole 10 with which a terminal screw is engaged, and a threaded hole 11 with which a screw is engaged to secure the stationary terminal 1 to a casing (not shown).

The stationary contactor 1 in which the direction of flow of current is changed because of the presence of the U-shaped hole 9, is advantageous in that, although the height of the stationary contact 3 is not increased, it is possible to cause the magnetic field to act in the direction in which the arc 8 should be elongated. However, the stationary contactor shown in FIGS. 10 and 11 suffers from a problem that, because the outside current paths la are flush with the surface on which the stationary terminal 3 is mounted, the outside current paths are liable to be exposed to the arc 8; that is, the stationary contactor 1 is liable to be greatly damaged by the arc.

SUMMARY OF THE INVENTION

In view of the foregoing, an object of the invention is to provide a circuit breaker in which a stationary contactor made of a flat conductive plate has one end portion which is formed into a terminal section, and the other end portion having a U-shaped hole in such a manner that two outside current paths are extended from the terminal section, the two outside current paths being joined together to form an inside current path which is extended towards the terminal, and has a stationary contact at its end; in which the stationary contactor is prevented from damage, and the current interrupting performance is improved.

The foregoing object has been achieved by the provision of a circuit breaker in which, according to the invention, a grid support is provided which is formed by molding resin, the grid support comprising a pair of side walls which are confronted with each other and extended upright, and have each a plurality of grooves in multi-stage formed in the inner surface, a cover plate through which the lower edges of the side walls are connected to each other, and legs protruded from the bottom surfaces of the side walls, arc-extinction grids are inserted into the grooves, respectively, the grid support is mounted over the stationary contactor with the legs fitted in the U-shaped hole on both sides of the stationary contact, the upper surfaces of the outside current paths are covered with the side walls, respectively, and the upper surface of the inside current path except for the stationary contact is covered with the cover plate.

It is preferable that, in the circuit breaker, the distance between the inner surfaces of the pair of side walls are made larger towards the terminal section, thereby to improve the arc extinguishing performance. In addition, it is preferable that, in the circuit breaker, a U-shaped arc horn is mounted on the upper surface of the stationary contactor along the outside current paths, and the grid support is mounted over the stationary contactor with the arc horn interposed between the grid support and the stationary contactor. In the circuit breaker thus designed, the arc extinguishing performance is improved, and the stationary contact is substantially prevented from damage.

The present invention further provides a grid support for a circuit breaker including a stationary contactor formed with a U-shaped hole defining a pair of outside current paths deviated laterally from each other and an inside current path located laterally between the outside current paths, the inside current path extending from the outside current path in a direction opposite to a direction wherein the outside current paths extend from a terminal section, the current path having a stationary contact at a distal end portion thereof, the grid support comprising:

a pair of right and left side walls confronted with each other and extending upright, each of the side walls having a plurality of grooves so that the side walls cooperatively support a plurality of arc-extinction grids therebetween;

a leg protruded from a bottom surface of each of the side walls, and insertable into the U-shaped hole for mounting the grid support onto the stationary contactor so that the side walls shield the outside current paths from an arc; and a cover plate extending between the side walls for partially covering the inner current path when the grid support is mounted onto the stationary contactor.

The circuit breaker and/or grid support of the present invention have the following advantages:

(1) The legs of the grid support are fitted in the U-shaped hole of the stationary contactor on both sides of the stationary contact, and the upper surfaces of the outside current paths are covered with the bottoms of the side walls, and the upper surface of the inside current path is covered with the cover plate. Hence, in the stationary contactor, the region around the stationary contact is shielded from the arc, thus being prevented from being damaged by the arc.

(2) The resin of the grid support side walls produces an arc extinguishing gas. The gas thus produced cools the arc. As a result, the arc voltage is greatly increased, and the arc extinguishing time is shortened as much. The resin material of the grid support is preferably a melamine resin which produces a large quantity of arc extinguishing gas.

(3) The two arms of each of the arc-extinction grids are accommodated in the grooves formed in the side walls of the grid support, and therefore they are prevented from being damaged by the arc.

(4) In the grid support, the distance between the inner surfaces of the side walls are larger towards the terminal section, thereby to improve the arc extinguishing performance. Hence, in the grid support, the pressure of the arc gas on the side of the stationary contact is higher than that of the arc gas on the side of the terminal section. This pressure difference elongates the arc towards the terminal section, and the arc voltage is further increased.

(5) In the grid support, the U-shaped arc horn is mounted on the upper surface of the stationary contactor along the outside current paths. In this case, the arc on the stationary is more effectively induced by the arc-extinction grids, while the foot of the arc is shifted to the arc horn, which prevents the stationary contact from being damaged by the arc detained.

DETAILED DESCRIPTION OF THE PREFERRED EMBODIMENTS

Figure 10:
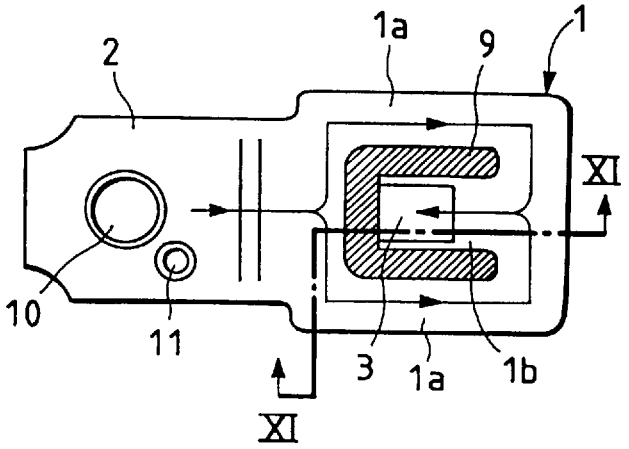
PRIOR ART FIG. 10
FIG. 10 is a plan view showing a stationary contactor having a U-shaped hole.
Figure 11:
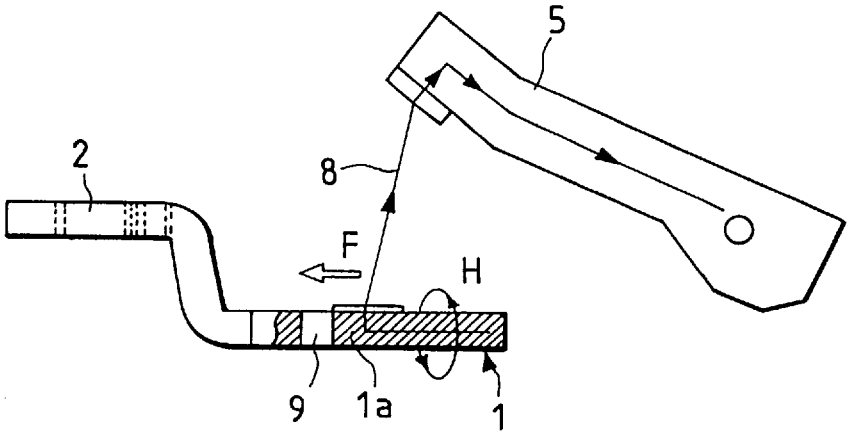
PRIOR ART FIG. 11
FIG. 11 is a sectional view, taken along line XI—XI in FIG. 10.

Preferred embodiments of the invention will be described with reference to FIGS. 1 through 7. In each of those embodiments, its stationary contactor is equal in structure to that which is shown in FIGS. 10 and 11.

Figure 1:
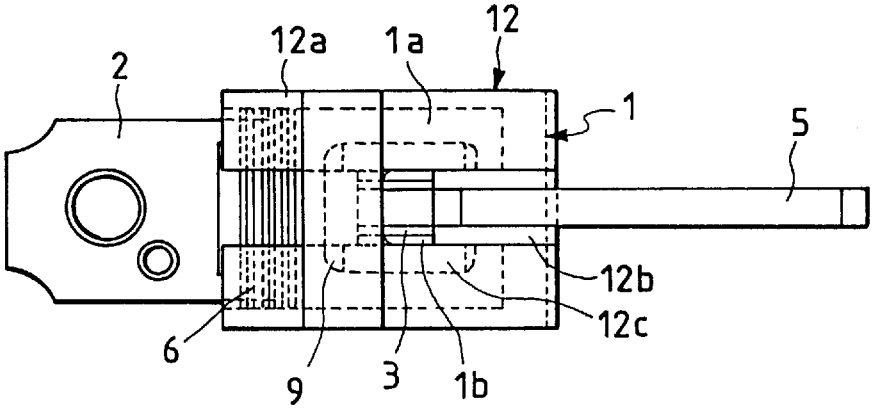
FIGS. 1 and 2 are a plan view and a side view, respectively, showing a contactor in a circuit breaker, which is an embodiment of the invention.
Figure 2:
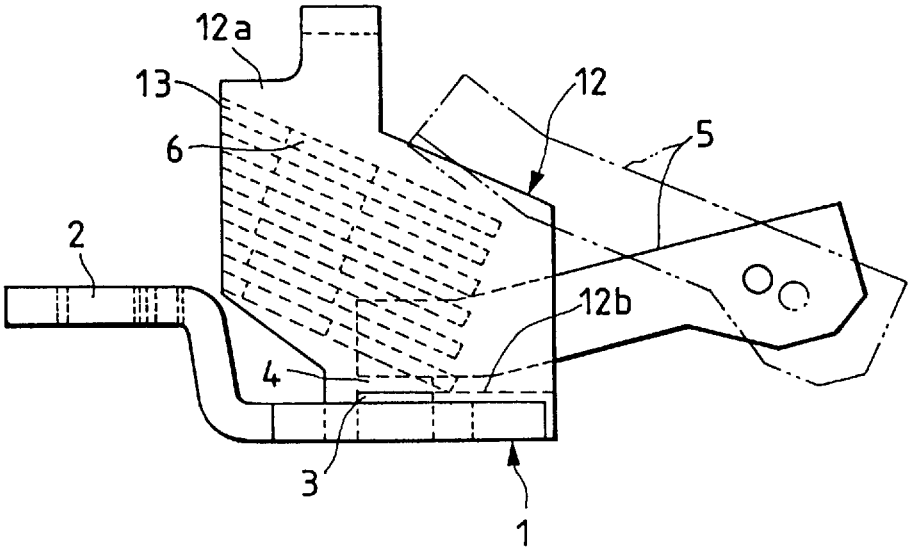
Figure 3:
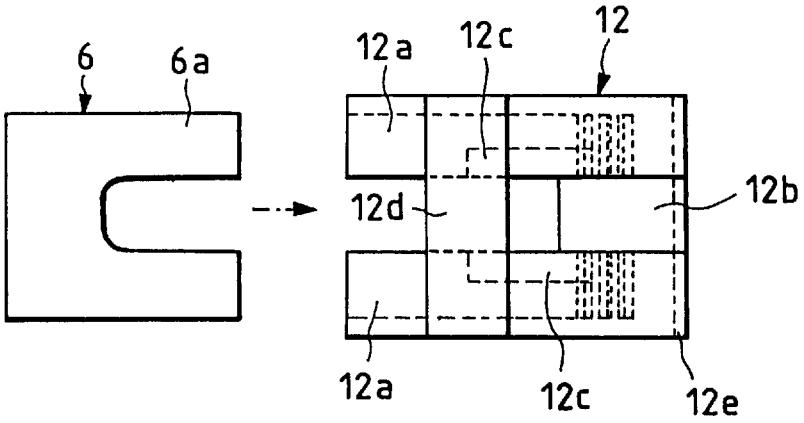
FIGS. 3 and 4 are an exploded plan view and an exploded side view, respectively, showing a grid support and an arc-extinction rid in the contactor shown in FIG. 1.
Figure 4:
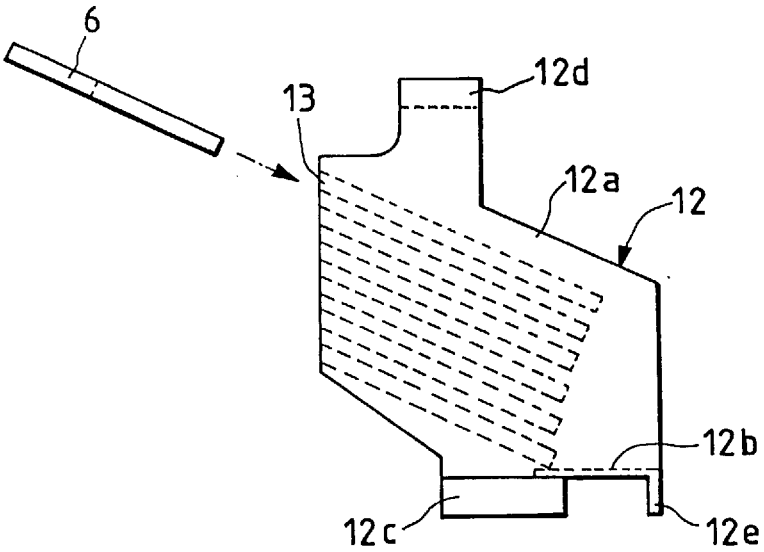

FIGS. 1 through 4 show the fundamental embodiment of the invention. More specifically, FIGS. 1 and 2 are a plan view and a side view, respectively, showing a contactor section. FIGS. 3 and 4 are an exploded plan view and a side view, respectively, showing a grid support and an arc-extinction grid.

As shown in FIGS. 3 and 4, the grid support 12 comprises: a pair of (right and left) side walls 12*a* which are confronted with each other and set upright; a cover plate 12*b* through which the lower edges of those side walls 12*a* are connected to each other; legs 12*c* protruded from the bottoms (lower end faces) of the side walls 12*a*; a coupling plate 12*d* bridging between rectangular pillar portions of the upper parts of the side walls 12*a*; and a wall plate 12*e* which is extended downwardly from the right end of the cover plate 12*b*. The above-described components 12*a* through 12*e* are formed as one unit (the grid support) by molding a melamine-group resin. The width of the grid support 12 is equal to that of the end portion, on the stationary contact side, of the stationary contactor 1 (FIG. 10), and the distance between the confronted inner surfaces of the side walls 12*a* is equal to the width of the inside current path 1*b* of the stationary contactor 1.

The side walls 12*a* have a configuration as shown in FIG. 4. The inner surface of each of the side walls 12*a* has a plurality of grooves 13 in multi-stage (six stages in FIG. 4) which are inclined so that arc-extinction grids 6 are inserted into the grooves 13. The distance between the bottoms of each of the pairs of right and left grooves 13 is slightly smaller than the width of the arc-extinction grid 6; that is, this slight dimensional difference fixedly supports the arc-extinction grid 6 on the grid support 12. The cover plate 12*b* is slightly smaller in wall thickness than the stationary contact 3. The cover plate 12*b* is secured to the right ends of the side walls 12*a* in such a manner that the bottom surface (the lower surface) of the cover plate 12*b* is flush with the lower end faces (edges) of the side walls 12*a*. The legs 12*c* are each rectangular in section having a width and a length which correspond to the linear portions of the U-shaped hole 9 which are on both sides of the inside current path 1*b*. Furthermore the legs 12*c* are protruded to a height which is equal to the wall thickness of the stationary contactor 1, and their inner surfaces are flush with the inner surfaces of the side walls 12*a*. The coupling plate 12*d* forms a gate together with the aforementioned rectangular pillar portions; that is, the side walls 12*a* are coupled through the coupling plate 12*e*. The wall plate 12*e* has a height equal to the wall thickness of the stationary contactor 1, and its rear surface is flush with the end faces of the side walls 12*a*.

The arc-extinction grid 6 is press-fitted into the respective pair of grooves 13 in the direction of the arrow until it abuts against the ends of the grooves. The depth of each of the grooves 13 is equal to the width of the arms 6*a* of the arc-extinction grid 6. The grid support 12 into which the arc-extinction grids have been press-fitted, is mounted over the stationary contactor 1 from above in such a manner that the legs 12*c* are fitted in the U-shaped hole 9 on both sides of the stationary contact 3. In this operation, the inner surfaces of the side walls 12*a* are flush with the side surfaces of the inside current path 1*b*, and the left end face (in the figure) of the cover plate 12*b* is brought into contact with the right end face of the stationary contact 3. Since the grid support 12 is mounted over the stationary contact in the above-described manner, the upper surfaces of the outside current paths 1*a* are covered with the side walls 12*a*, and the upper surface of the inside current surface except for the stationary contact is covered with the cover plate 12*b*. After the grid support 12 is mounted over the stationary contact 1, the grid support 12 is fixed with the upper surface of the coupling plate 12*d* being pressed with the cover (not shown) of the circuit breaker body.

As is apparent from the above description, the outside current paths 1*a* are shielded from the arc by the side walls 12*a*. Therefore, although the outside current paths and the stationary contact mounting surface are on one and the same plane, they are prevented from being damaged by the arc. In addition, the upper surface of the inside current path 1*b* is shielded from the arc by the cover plate 12*b*, and therefore it is also prevented from being damaged by the arc. On the other hand, the position of the foot of the arc is limited to the stationary contact 3. Hence, the induction of the arc towards the arc-extinction grids is enhanced, and the elongation of the arc is accelerated. It is not always necessary to provide the wall plate 12*e*. However, the provision of the wall plate 12*e* is effective in shielding the current paths from the arc, and enhances the positioning of the grid support 12 with respect to the stationary contactor 1. Furthermore, the arms 6*a* of the arc-extinction grid 6 are held in the grooves 13, being isolated from the arc. Hence, the arc-extinction grid is minimally heated. On the other hand, the side walls 12*a* are liable to contact the arc 8. In this case, the resin material produces a large quantity of arc extinguishing gas, thus sufficiently cooling the arc 8. In this operation, since the space between the side walls 12*a* large in wall thickness is small, the internal pressure is greatly increased by the arc gas, thus effective drawing the arc 8.

Figure 5:
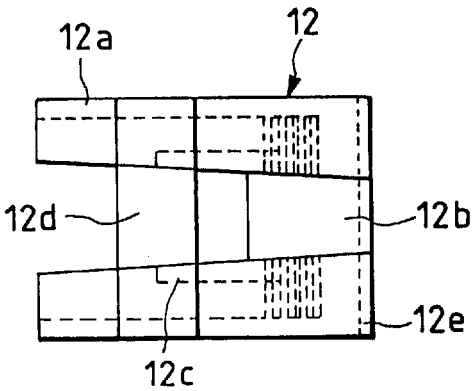
FIG. 5 is a plan view showing one modification of the grid support.

FIG. 5 is a plan view showing one modification of the grid support 12. In the modification, the distance between the inner surfaces of the side walls 12*a* which are confronted with each other are larger towards the terminal section 2. In other words, the distance between the right ends (in the figure) of the side walls 12*a* is equal to the width of the inside current path 1*b*; however, the distance between the left ends of the side walls 12*a* is larger than the width of the inside current path. In the grid support 12 shown in FIG. 5, the arc gas pressure on the side of the stationary contact 3 is higher than that on the side of the terminal section 2. This pressure difference markedly elongates the arc 8 towards the terminal section 2, so that the arc voltage is further increased.

Figure 6:
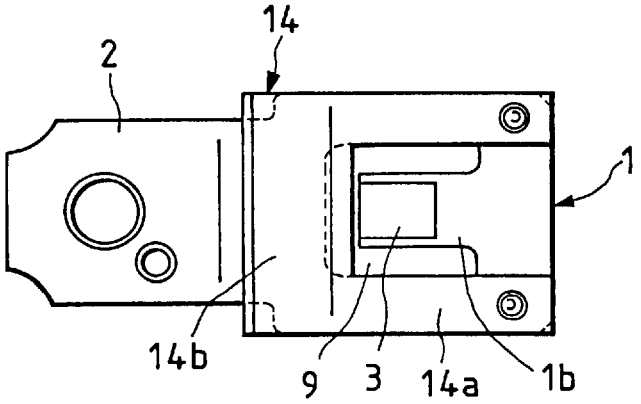
FIGS. 6 and 7*a* are a plan view and a side view, respectively, showing the stationary contact with an arc horn which constitutes another embodiment of the invention.
Figure 7A:
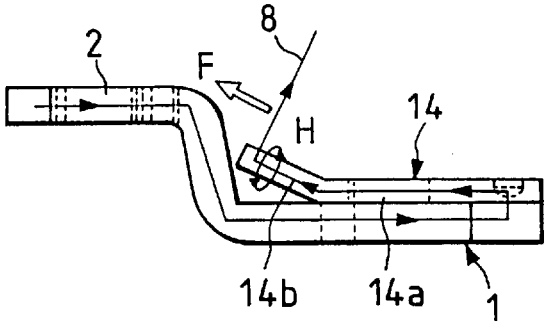
Figure 7B:
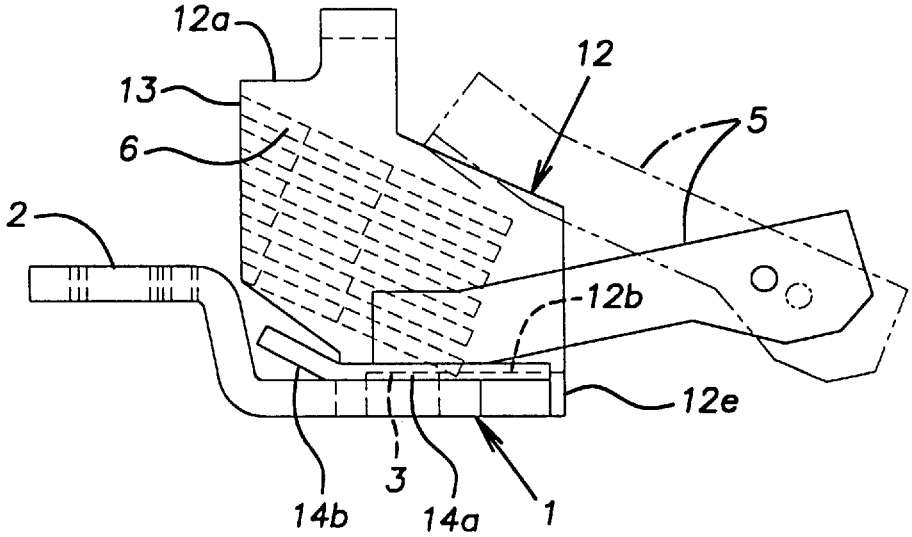
FIG. 7*b* is a side view showing the stationary contactor with the arc horn of FIGS. 6 and 7*a*, in a circuit breaker.
Figure 8:
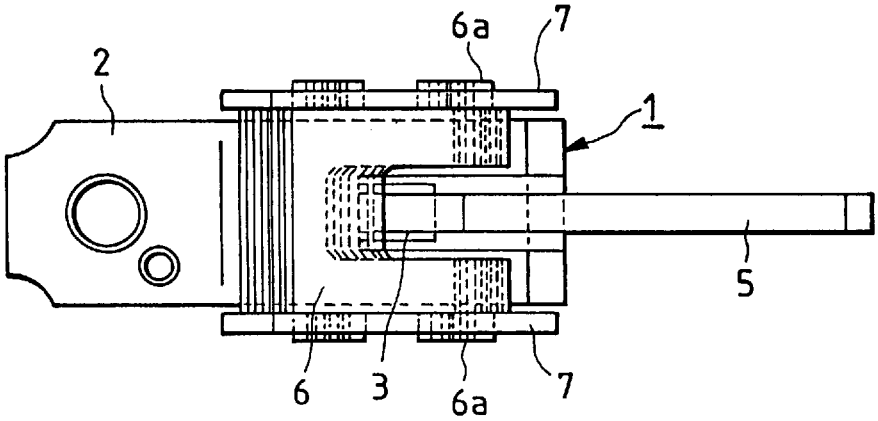
PRIOR ART FIG. 8
FIGS. 8 and 9 are a plan view and a side view, respectively, showing a contactor in a conventional circuit breaker.
Figure 9:
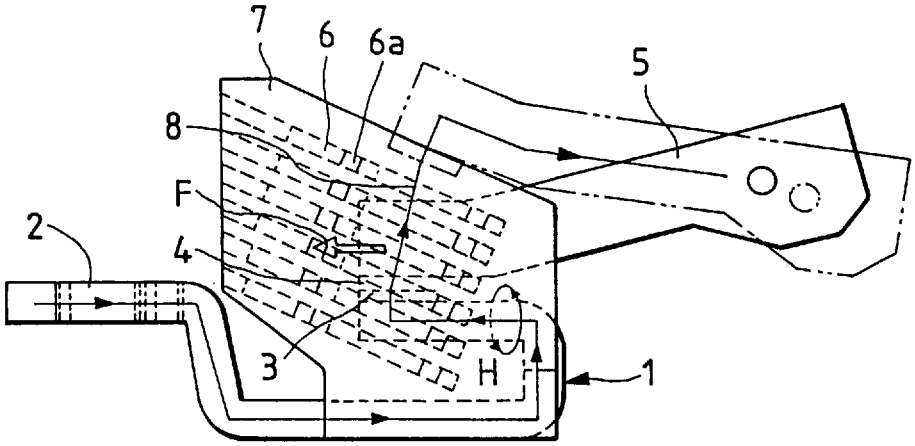
PRIOR ART FIG. 9

FIGS. 6, 7*a*, and 7*b* show another embodiment of the invention in which a U-shaped arc horn 14 is provided on the upper surface of the stationary contactor 1 in such a manner that it is extended along the outside current paths 1*a*. More specifically, FIGS. 6 and 7*a* are a plan view and a side view, respectively, showing the stationary contactor with the arc horn. The arc horn 14 is made of a steel plate, and is U-shaped having a pair of arms 14*a* and a horn portion 14*b* between the latter 14*a* in such a manner that the width of the arms 14*a* is equal to that of the outside current paths 1*a*. The horn portion 14*b* is bent with respect to the arms 14*a*, thus being set obliquely raised. The arc horn 14 is secured to the stationary contactor 1 as follows: That is, cylindrical protrusions extruded from the stationary contactor 1 are fixedly fitted in mounting holes by caulking which are formed in the end portion of the arms 14*a*.

With the arc horn 14 mounted on the stationary contactor, the foot of the arc is readily shifted from the stationary contact 3 to the horn portion 14*b*, which prevents the damage of the stationary contact 3 due to the detention of the foot of the arc. Furthermore, even after the arc 8 is shifted onto the arc horn 14, as shown in FIG. 7*a* the magnetic fields H formed by the currents flowing in the arms act to apply a leftward force F to the arc 8, so that the elongation of the latter 8 is continued. Similarly as in the case of FIGS. 1 and 2, the grid support 12 is mounted over the stationary contactor 1 with the arc horn 14 interposed between them. In this case, the arms 14*a* of the arc horn 14, on which the side walls 12*a* of the grid support are mounted, form steps with the inside current path 1*b* with which the cover plate 12*b* is brought into contact. Therefore, it is necessary to form recesses in the bottoms of the side walls 12*a* in correspondence to the steps.

The circuit breaker of the invention, in which the grid support formed by molding resin is fixedly mounted on the stationary contactor having the U-shaped hole, has the following effects or merits:

(1) The grid support shields the region around the stationary contact of the stationary contactor from the arc. Hence, the stationary contact is substantially prevented from being damaged by the arc, and the induction of the arc towards the arc-extinction grids is increased, which improves the current interrupting performance of the circuit breaker.

(2) The side walls of the grid support produce the arc extinguishing gas. The gas thus produced cools the arc, which further improves the current interrupting performance of the circuit breaker.

(3) Both arms of each of the arc-extinction grids are shield from the arc by the side walls of the grid support, thus being prevented from being damaged (molten or splashed) by the arc.

(4) In this connection, the distance between the inner surfaces of the side walls are made larger towards the terminal section, which improves the arc extinguishing performance. Hence, in the grid support, the pressure difference accelerates the elongation of the arc.

(5) In the grid support, the U-shaped arc horn is mounted on the upper surface of the stationary contactor along the outside current paths. In this case, the arc on the stationary contact is more effectively induced by the arc-extinction grids, and the damage of the stationary contact due to the detention of the arc is decreased.

What is claimed is:

1. A circuit breaker comprising a stationary contactor which is made of a flat conductive plate, and has one end portion which is formed into a terminal section, and the other end portion having a U-shaped hole in such a manner that a pair of outside current paths are extended from said terminal section, and said outside current paths are joined together to follow an inside current path which is extended towards said terminal section, and has a stationary contact at the end thereof, wherein:

a grid support is included which is formed by molding resin, said grid support comprising a pair of right and left side walls which are confronted with each other and extended upright, and have each a plurality of grooves in multi-stage formed in the inner surface thereof, a cover plate through which the lower edges of said side walls are connected to each other, and legs protruded from the bottom surfaces of said side walls, arc-extinction grids are inserted into said grooves, said grid support is mounted over said stationary contactor with said legs fitted in said U-shaped hole on both sides of said stationary contact, the upper surfaces of said outside current paths are covered with said side walls, respectively, and the upper surface of said inside current path except for said stationary contact is covered with said cover plate.

2. A circuit breaker as claimed in claim 1, wherein a distance between the inner surfaces of said pair of side walls is larger towards said terminal section.

3. A circuit breaker as claimed in claim 1 or 2, wherein:

a U-shaped arc horn is mounted on the upper surface of said stationary contactor along said outside current paths, and said grid support is mounted over said stationary contactor with said arc horn is interposed between said grid support and said stationary contactor.

4. A grid support for a circuit breaker including a stationary contactor formed with a U-shaped hole defining a pair of outside current paths deviated laterally from each other and an inside current path located laterally between said outside current paths, said inside current path extending from said outside current paths in a direction opposite to a direction wherein said outside current paths extend from a terminal section, said inside current path having a stationary contact at a distal end portion thereof, said grid support comprising:

a pair of right and left side walls confronted with each other and extending upright, each of said side walls having a plurality of grooves so that said side walls cooperatively support a plurality of arc-extinction grids therebetween;

a leg protruding from a bottom surface of each of said side walls, and insertable into said U-shaped hole for mounting said grid support onto said stationary contactor so that said side walls shield said outside current paths from an arc; and a cover plate extending between said side walls for partially covering said inner current path when said grid support is mounted onto said stationary contactor.

5. A grid support as claimed in claim 4, wherein said side walls cooperatively define a tapered space enlarged in the direction wherein said inside current path extends from said outside current path.

6. A grid support as claimed in claim 4, wherein said bottom surface of each of said side walls is placed on and in contact with a respective one of said outside current paths when said grid support is mounted onto said stationary contactor.

7. A grid support as claimed in claim 4, wherein said bottom surface of each of said side walls is placed on and in contact with a U-shaped arc horn mounted on said stationary contactor.

8. A grid support as claimed in claim 4, wherein said bottom surface of each of said side walls is flush with said cover plate.

9. A grid support as claimed in claim 4, wherein said bottom surface of each of said side walls has a level difference from said cover plate.

10. A grid support as claimed in claim 4, wherein said cover plate covers an upper surface of said inner current path to exclusively expose said stationary contact.

* * * * *